US010762792B2

(12) United States Patent
Ballestros et al.

(10) Patent No.: US 10,762,792 B2
(45) Date of Patent: Sep. 1, 2020

(54) SYSTEM AND METHOD FOR VERIFYING ADS-B MESSAGES

(71) Applicant: The Boeing Company, Chicago, IL (US)

(72) Inventors: Pedro Taboso Ballestros, Madrid (ES); Rosa Maria Rodriguez, Madrid (ES); Florencio Cano Serrano, Madrid (ES)

(73) Assignee: THE BOEING COMPANY, Chicago, IL (US)

( * ) Notice: Subject to any disclaimer, the term of this patent is extended or adjusted under 35 U.S.C. 154(b) by 495 days.

(21) Appl. No.: 15/285,450

(22) Filed: Oct. 4, 2016

(65) Prior Publication Data

US 2017/0236425 A1 Aug. 17, 2017

(30) Foreign Application Priority Data

Oct. 5, 2015 (ES) ..... 15382485

(51) Int. Cl.
*G08G 5/00* (2006.01)
*G08G 5/04* (2006.01)

(52) U.S. Cl.
CPC ..... *G08G 5/0008* (2013.01); *G08G 5/0021* (2013.01); *G08G 5/045* (2013.01)

(58) Field of Classification Search
CPC ..... G08G 5/0008; G08G 5/045; G08G 5/0021
USPC ..... 342/32
See application file for complete search history.

(56) References Cited

U.S. PATENT DOCUMENTS 7,570,214 B2 * 8/2009 Smith ..... G01S 5/0027 342/451
8,948,933 B2 * 2/2015 Pangilinan ..... G08G 5/0021 701/3
2011/0057830 A1 * 3/2011 Sampigethaya ..... G01S 5/0072 342/36
2012/0041620 A1 * 2/2012 Stayton ..... G08G 5/0008 701/3

FOREIGN PATENT DOCUMENTS

EP 3088911 B1 3/2019

OTHER PUBLICATIONS

European Patent Office Search Opinion on EP15382485.9 dated May 3, 2016 (Year: 2016).*

(Continued)

*Primary Examiner* — Frank J McGue
(74) *Attorney, Agent, or Firm* — Moore Intellectual Property Law, PLLC

(57) ABSTRACT

A system and method for verifying ADS-B messages received at an aircraft from other aircraft within its ADS-B range. This disclosure enhances the current Automatic Dependent Surveillance-Broadcast (ADS-B) IN surveillance systems, and the disclosed system is an onboard system designed to enable ADS-B IN capable aircraft to verify the information received via ADS-B from the rest of the aircraft within its ADS-B range. The system's performance is based on the principles of multilateration (MLAT). The system performs MLAT calculations to determine whether the ADS-B messages received are truthful or not truthful. The disclosed system relies on a communication protocol based on a series of requests and responses to interchange the information needed by the aircraft involved in the process to carry out the MLAT calculations.

20 Claims, 8 Drawing Sheets

(56) References Cited

OTHER PUBLICATIONS

Communication Pursuant to Article 94(3) EPC issued in corresponding EP15382485.9 dated Apr. 16, 2019, 6 pages.
Office Action dated Jun. 18, 2019 issued by Canadian Intellectual Property Office in corresponding CA Application No. 2,940,826, 4 pgs.

* cited by examiner

13

13a 13b 13c 13d $TW_n$ - AIRCRAFT A

| AIRCRAFT ID | ADS-B POSITION | TIME STAMP | VERIFIED |
|---|---|---|---|
| $Id_B$ | $(X_B, Y_B, Z_B)$ | $TS^B_A$<br>$TS^B_C$<br>$TS^B_D$<br>$TS^B_E$ | YES<br>TRUTHFUL<br>✓ |
| $Id_C$ | $(X_C, Y_C, Z_C)$ | $TS^C_A$<br>$TS^C_B$<br>$TS^C_D$<br>$TS^C_E$ | YES<br>TRUTHFUL<br>✓ |
| $Id_D$ | $(X_D, Y_D, Z_D)$ | $TS^D_A$<br>$TS^D_B$ | NO ? |
| $Id_E$ | $(X_E, Y_E, Z_E)$ | $TS^E_A$<br>$TS^E_B$<br>$TS^E_C$<br>$TS^E_D$ | YES<br>UNTRUTHFUL<br>✓ |

FIG. 3

SYSTEM AND METHOD FOR VERIFYING ADS-B MESSAGES

REFERENCE TO RELATED APPLICATION

This application is a continuation of and claims priority of EP15382485 filed Oct. 5, 2015, entitled "System and Method for Verifying ADS-B Messages," which application is incorporated herein in its entirety by this reference.

BACKGROUND OF THE INVENTION

1. Field of the Invention

The present disclosure is generally related to the field of the security transmission of information between aircraft, and more particularly, to provide readable tools against ADS-B (Automatic Dependent Surveillance-Broadcast) spoofing.

2. Related Art

Automatic Dependent Surveillance Broadcast (ADS-B) systems are a source of surveillance for airborne aircraft. ADS-B OUT provides a means of automated aircraft parameter transmission between the aircraft and the Air Traffic Control (ATC), and ADS-B provides automated aircraft parameter transmission between the aircraft themselves. ADS-B systems broadcast information without any security measures like authentication or ciphering. Therefore, it is easy for an attacker to reproduce false ADS-B messages ("spoofing") providing false aircraft position, aircraft velocity, aircraft ID, or any other ADS-B data.

One solution is provided in the U.S. Pat. Publication No. 2012/0041620 A1, Stayton et al., which discloses how an intruder bearing can be calculated based on the parameters from a Traffic Alert and Collision Avoidance System (TCAS) and from the ADS-B system. However, the provided solution depends on the accuracy of the signals emitted and received by the antenna of the TCAS system. Consequently, the provided solution is dependent on any reflections or blockages of the signals.

Accordingly, there is a need for an improved system and method that overcomes the above-mentioned drawbacks.

SUMMARY

A system for and method of verifying ADS-B messages are disclosed. An aircraft may continuously receive ADS-B messages from other aircraft that are airborne in its vicinity, defined by ADS-B range of the s aircraft. Therefore a system for verifying the ADS-B messages is required. In general, the present disclosure provides a system for verifying ADS-B messages for an aircraft provided with an Automatic Dependent Surveillance-Broadcast (ADS-B) system comprising a Mode S transponder. A system of the present disclosure may comprise:

a receiver module configured to demodulate and decode the signals received from the Mode S transponder, wherein the receiver module determines the type of message received and then extracts and parses the information from each type of message, the message types being an ADS-B message, a request message, or a response message;

a processor module configured to process the information extracted and parsed by the receiver module so that the processor module calculates: whether the information provided is enough to perform telemetry calculations; if so, the processor module is further configured to perform telemetry calculations and to compare the telemetry calculations with the position of the aircraft contained in the ADS-B message being a truthful ADS-B message if both match; or, alternatively, to send a request message, a response message, or both; and a transmitter module configured to format the request message and the response message for sending the request message and the response message to the Mode S transponder.

The present disclosure also provides a method for verifying ADS-B messages for an aircraft provided with an Automatic Dependent Surveillance Broadcast (ADS-B) systems. The method may comprise the following steps (or sub-processes):

i) gathering ADS-B message information for a periodic time window received by an aircraft from aircraft within ADS-B range, the information comprising:
   a) an aircraft ID; an aircraft position for said aircraft ID;
   b) a time of arrival for said aircraft ID; and
   c) a timestamp for each aircraft ID;

ii) checking for each aircraft within an ADS-B range, whether there are at least four timestamps gathered from other aircraft;
   a) for a positive case, performing telemetry calculations for each aircraft ID and comparing with the aircraft position so that the ADS-B message received is truthful if both match or untruthful if not; or
   b) for a negative case: continue;

iii) checking whether a request message from other aircraft within the ADS-B range is received within a predetermined time delay;
   a) for an affirmative case: broadcasting a response message having the ADS-B message information gathered for the periodic time window; or,
   b) for a negative case: continue; and iv) broadcasting a request message after the predetermined time delay to the aircraft within the ADS-B range; and repeating sub-processes i) through iii).

As used herein, a system, apparatus, structure, article, element, component, or hardware configured to perform a specified function is indeed capable of performing the specified function without any alteration, rather than merely having potential to perform the specified function after further modification. In other words, the system, apparatus, structure, article, element, component, or hardware configured to perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being configured to perform a particular function may additionally or alternatively be described as being adapted to and/or as being operative to perform that function.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

FIG. 3 illustrates an example of a table included in the system for verifying ADS-B messages.

DETAILED DESCRIPTION

In the following description, "node" is used as a synonym of "aircraft" because both have the same meaning within the field of the present disclosure. Additionally method and process may be used interchangeably herein where the method contains sub-processes.

The present disclosure describes embodiments of the system and method for verifying ADS-B (Automatic Dependent Surveillance-Broadcast) messages interchanged among several nodes. The disclosed verification system and method are effective against attackers which use ADS-B messages as a supporting platform for carrying out their attacks. Advantageously, the disclosed verification system and method are focused on the ADS-B messages received at the aircraft, in contrast to the prior art that uses encryption techniques.

Figure 1:
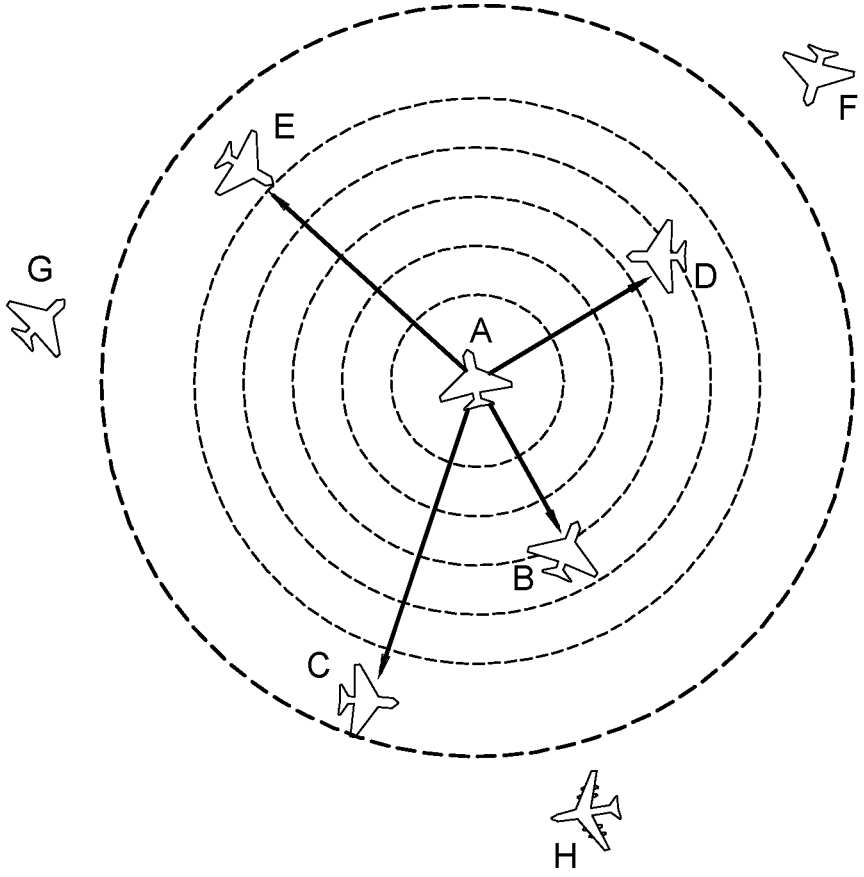
FIG. 1 illustrates an exemplary flight situation where an aircraft A is surrounded by aircraft within and without the ADS-B range of the aircraft A.

Shown in FIG. 1 is a schematic sketch that illustrates the positioning of an aircraft A and seven surrounding aircraft B through H while airborne, all of them provided with Automatic Dependent Surveillance-Broadcast (ADS-B) systems and Mode S transponders. Aircraft A wants to verify the ADS-B messages received from the nodes within its ADS-B range, i.e., those messages received from Aircraft B through E.

Figure 2:
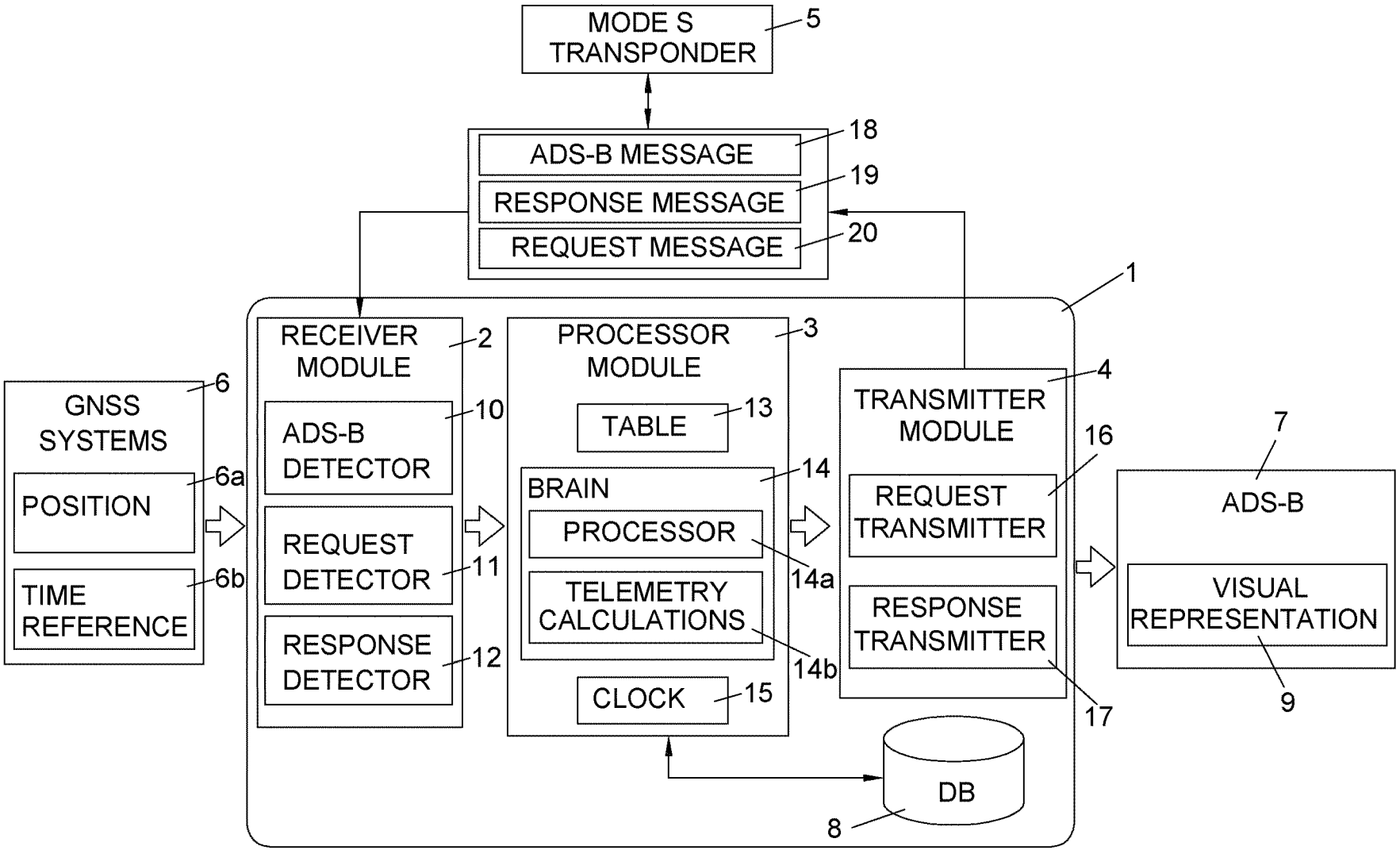
FIG. 2 shows a block diagram of an example of a system for verifying ADS-B messages.

In order to do the above, Aircraft A and all the aircraft within ADS-B range of the Aircraft A have to be provided with the system and method of this disclosure. Shown in FIG. 2 is a block diagram of an example of a system 1 for verifying ADS-B messages that includes a receiver module 2, a processor module 3, a transmitter module 4, and a database 8. The system 1 is in signal communication with a Global Navigation Satellite System (GNSS) 6, the Mode S transponder 5, and the ADS-B system 7. The system 1 may be configured so that only those verified ADS-B messages are sent to the ADS-B system 7, or all the ADS-B messages are sent to the ADS-B system 7 but each of them labeled as TRUTHFUL or UNTRUTHFUL for the flight crew's information. The information is shown to the flight crew by means of a visual representation in a screen 9.

The GNSS system 6 provides, for the example embodiment shown in FIG. 2, the aircraft A position and a time reference for aircraft A which is also the same time reference for all the nodes B through H. The Mode S transponder 5 provides the received messages from the surrounding nodes B through H to the system 1 and also broadcasts the messages from the system 1 to the surrounding nodes B through H.

The receiver module 2 is a processor configured to demodulate and decode the signals received from the Mode S transponder 5. The system 1 of the present disclosure uses three types of messages: the ADS-B messages 18 commonly used by the ADS-B systems, request messages 20, and response messages 19. Consequently, the system 1 is also configured to determine the type of message received and then to extract and parse the information contained in each kind of message. In order to process each kind of message, the receiver module 2 may include the ADS-B detector 10 configured to identify the ADS-B messages 18, the request detector 11 configured to identify the request messages 20 and the response detector 12 configured to identify the response messages 19.

The processor module 3 may include several sub-modules 13-15, each one of them configured to process the information extracted and parsed by the receiver module. The processor module 3 may include a table 13, a brain 14, and a clock 15. The clock 15 provides the time reference to the system 1 and it is synchronized with the time provided by the GNSS system 6. The brain 14 is a processor **14*a* in charge of determining whether the ADS-B data received is truthful or not. The brain 14 receives information comprising aircraft ID, aircraft position, and time of arrival (TOA) from the receiver module 2, places it in the table 13, performs telemetry calculations 14*b*, compares the results with the ADS-B position claimed (aircraft position within the ADS-B message), and determines when to send a request message or a response message. With the method described herein, the system 1** is able to determine whether the information provided is enough to perform telemetry calculations and also whether the request messages or the response messages have to be sent.

If the information provided is enough to perform telemetry calculations, the processor **14*a* performs the telemetry calculations 14*b* and compares the telemetry calculations with the position 6*a* of the aircraft contained. ADS-B message being the ADS-B message TRUTHFUL if both match. If the information provided is not enough to perform telemetry calculations, a request message 20 from the node A is sent to the nodes B to E within ADS-B range. The nodes B to E respond to node A with response messages 19. The database 8 is in signal communication with the processor module 3 for storing the information needed by the processor module 3** and data to perform telemetry calculations.

The telemetry calculations are based on multilateration (MLAT). MLAT may be defined as a cooperative surveillance application that accurately establishes the position of transmitters. MLAT uses data from an aircraft that can be transmitted in response to different technologies such as Mode S or ADS-B. The transmitted signal by an aircraft will be received by each of the nodes at fractionally different times. Using advanced computer processing techniques, these individual time differences allow an aircraft's position to be accurately calculated. The basic idea in MLAT is to have at least "n" equations to estimate "n" variables. Considering an emitter (Aircraft A in FIG. 1) at an unknown location vector (x, y, z) and that the source is within range of N receivers at known locations (aircraft B through E), the distance ($d_i$) from the emitter to one of the receivers is:

$$d_i=\sqrt{(x_i-x)^2+(y_i-y)^2+(z_i-z)^2}.$$

The TDOA equation for receivers i and m is:

$$TDOA_{i-m}=TDOA_i-TOA_m.$$

Considering the speed of light (c), there is a direct relation between the previous equations for $c_i$ and $TDOA_{i-m}$:

$$c\cdot TDOA_{i-m}=d_i-d_m$$

where:

TDOA is the Time-Difference of Arrival;

$x_i$, $y_i$ and $z_i$ is the position of each receiver (aircraft as receiver stations); and x, y, and z is the position of the emitter aircraft.

Thus, in order to accurately establish the position of the emitter, at least four receivers may be needed.

An example of a table included in the system for verifying ADS-B messages of the table 13 of FIG. 2 is shown in FIG. 3. The system 1 only processes ADS-B messages during determined time slots labeled as $TW_1$, $TW_2$, . . . , $TW_n$ and named as Time Window identifier (TW Identifier). The first column 13*a* of the table 13 is for the Aircraft ID, which is a 24-bit field for each aircraft address of every ADS-B message extracted and stored. The second column 13*b* of the table 13 is for the aircraft position contained in each ADS-B message. The third column 13*c* of the table 13 is for the timestamp $TS_X^Y$, i.e., the time of arrival registered by Aircraft X regarding an ADS-B message sent by Aircraft Y. Therefore, the first value is the "own" timestamp (FIG. 3, $TS_A^B$, the exact instant when the Aircraft A receives the ADS-B message from Aircraft B) and the rest of the values are "external" timestamps since they are those timestamps registered by other nodes (Aircraft B through E), as a consequence of a request message; i.e., Aircraft A broadcasts a request message and Aircraft B through E respond with response messages. The timestamp is referred to as the beginning of a concrete $TW_i$. The fourth column 13*d* of the table 13 is for the verified status. The verified status provides two types of information: whether or not (FIG. 3, YES/NO) there is enough information for performing the telemetry calculations, and whether the ADS-B message is TRUTHFUL or UNTRUTHFUL.

Thus, for the example embodiment of table 13 shown in FIG. 3 according to the situation shown in FIG. 1, the table 13 is the table for the Aircraft A in a time window $TW_n$, having enough information for performing telemetry calculations for the nodes B, C, and E, and not having enough information for performing telemetry calculations for the node D. Among those nodes having enough information for performing telemetry calculations, nodes B and C are considered as TRUTHFUL since their ADS-B claimed positions match with the telemetry calculations, and node E is considered as UNTRUTHFUL since its ADS-B claimed position does not match with the telemetry calculations for the Aircraft E.

Returning to FIG. 2, the transmitter module 4 is configured to format the request message and the response message for sending the request messages and the response messages to the Mode S transponder 5. The Mode S transponder 5 of the node A broadcasts signals containing request messages to the nodes within the ADS-B range of the Aircraft A, i.e., nodes B, C, D, and E (see FIG. 1).

Figure 4:
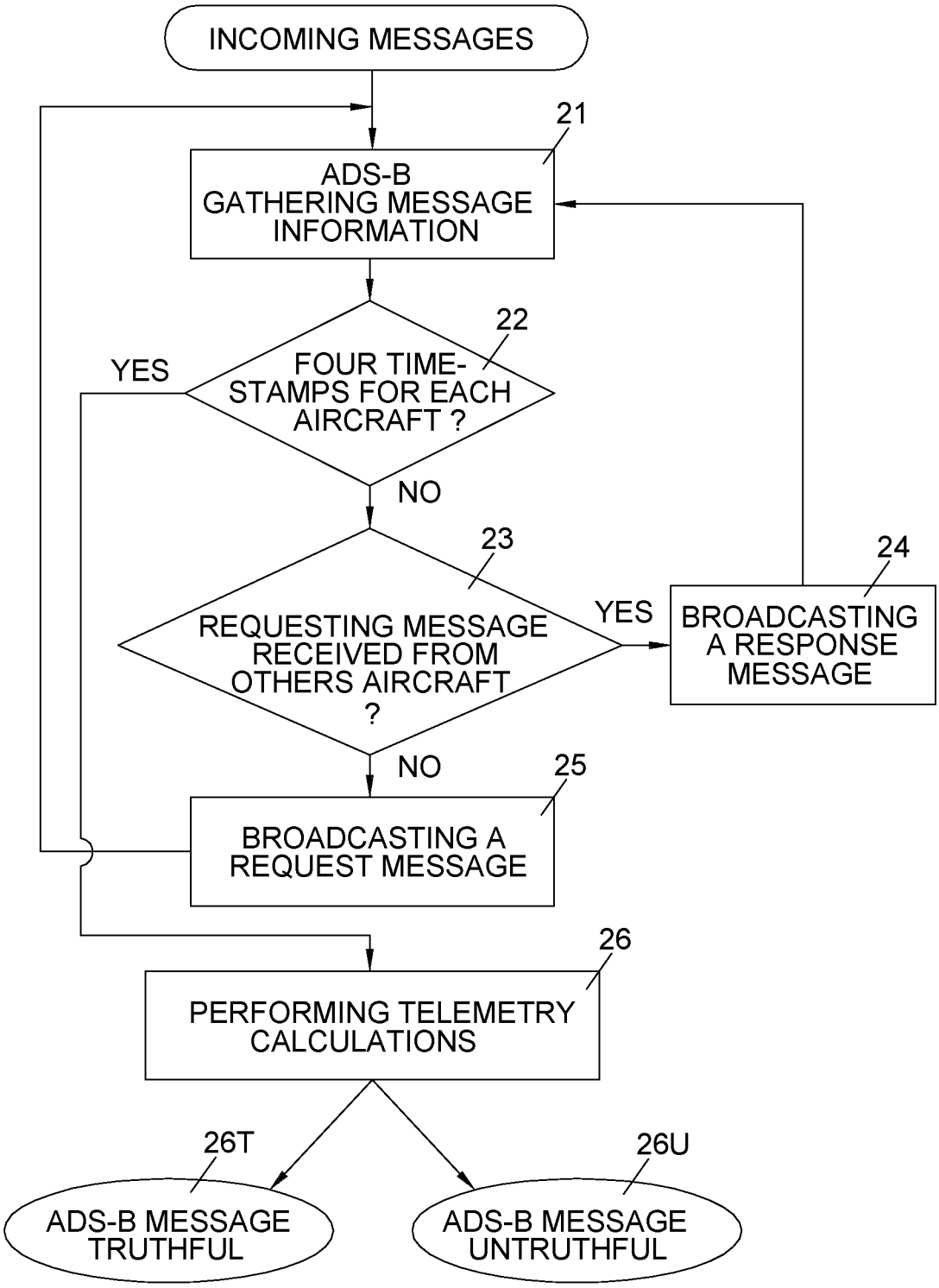
FIG. 4 illustrates a flow chart description of an example of a process for verifying ADS-B messages in accordance with the present disclosure.

The system performs a process that can be summarized as shown in FIG. 4. The system (installed in aircraft A for the example embodiment shown in FIG. 1) firstly gathers ADS-B message information in step 21 from the nodes within ADS-B range (aircraft B through E for the exemplary embodiment shown in FIG. 1). This gathering process is typically done for a periodic time window. The ADS-B messages are those received by a node (FIG. 1, aircraft A) from the nodes within the ADS-B range (FIG. 1, aircraft B through E). The information contained in the ADS-B message comprises at least the aircraft ID of the sender node (FIG. 1, aircraft B through E), the position of the sender node, and the time of arrival of the aircraft ID of the sender node. The receiver node (FIG. 1, aircraft A) adds the timestamp to each received message which timestamp is also stored in the table. The information extracted from the ADS-B messages is used to map the group of nodes (surrounding aircraft within ADS-B range as shown in FIG. 1). The information received via ADS-B may be considered untrustworthy by default. Then, the system checks whether or not the nodes within ADS-B range (FIG. 1, aircraft B through E) can be verified in decision step 22.

In order to verify the node, the system applies MLAT calculations (telemetry calculations) to the information contained in the ADS-B messages. It is advisable when applying telemetry calculations to be provided with at least four timestamps per each node to be verified. Decision step 22 determines if there are at least four timestamps gathered from each of the other aircraft. It is appreciated by thus skilled in the art that the number of timestamps gathered may vary under different circumstances or embodiments.

In case the system needs additional information to perform telemetry calculations, e.g., there are less than four timestamps for an aircraft, the process proceeds to decision step 23, where a check is made as to whether a request message from other aircraft within the ADS-B range has been received within a predetermined time delay. If the answer is affirmative, a response message having the ADS-B message information gathered for the periodic time window is broadcast in step 24, after which the process returns to step 21. If the answer is negative, the process proceeds directly to step 25.

As a security measure, the system may await a time (a random time delay) before broadcasting the request messages in step 25 to ensure that no other request messages from other nodes is received in step 23. Then, the system (FIG. 1, aircraft A) receives the response messages of the nodes within the ADS-B range (FIG. 1, aircraft B through E). The response messages contain the table of each node. Then, the system checks whether or not the information contained in the received messages is enough to perform telemetry calculations in step 26. In a positive case, the system is able to determine whether the ADS-B message is TRUTHFUL 26T or UNTRUTHFUL 26U. The ADS-B message is TRUTHFUL when the performed telemetry calculations turn out a position for the aircraft that matches with the position contained in the ADS-B message. In a negative case, the system reverts to the step in which the request messages are broadcasting.

Figure 5:
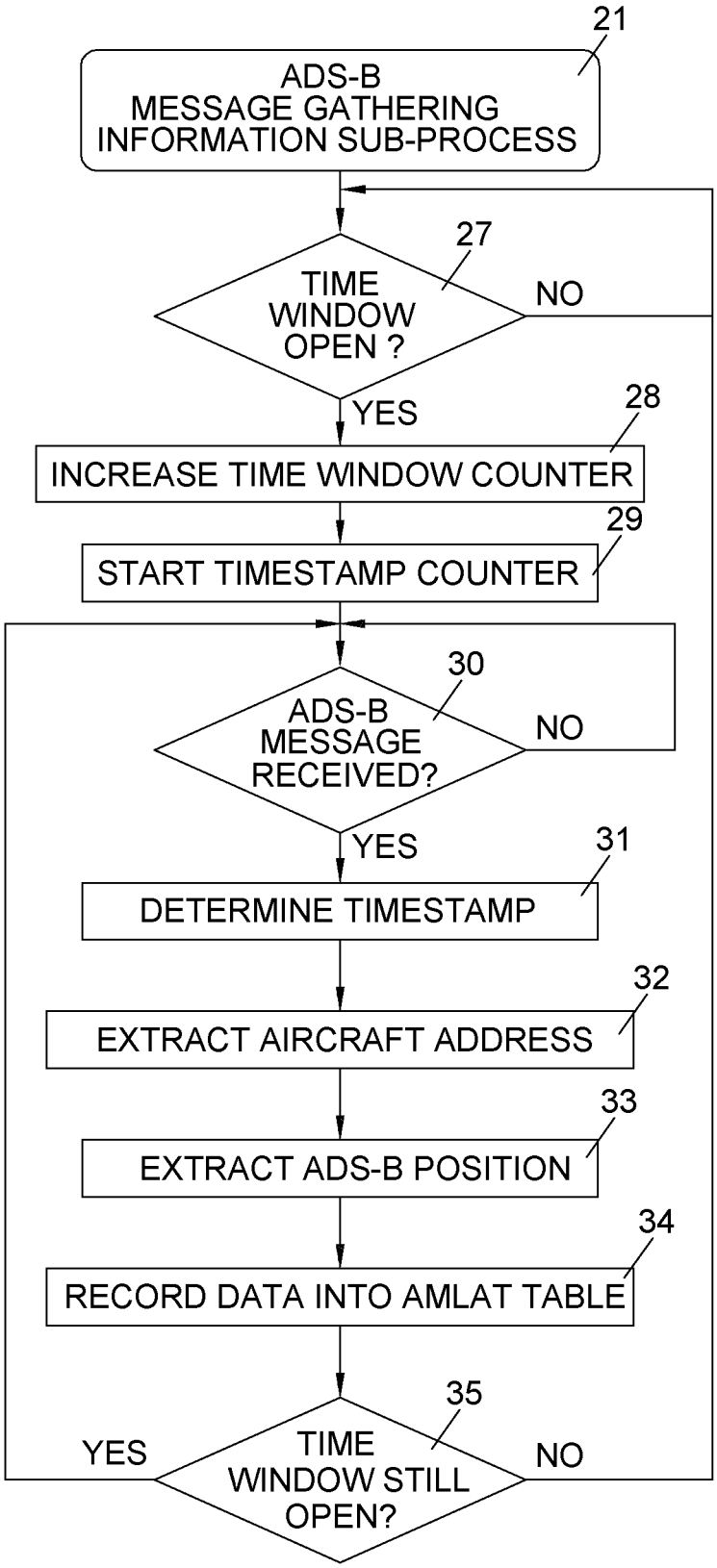
FIG. 5 illustrates a flow chart description of an example of a sub-process for gathering ADS-B messages information in accordance with the present disclosure.

The above-mentioned gathering sub-process of ADS-B message information 21 is shown in more detail in FIG. 5. With this gathering sub-process, the system is able to determine the nodes of the group to be verified. The ADS-B message gathering sub-process may be described as follows. Firstly, the system 1 is initialized (automatically or at the flight crew's discretion) after the ADS-B-IN systems (ATSAW, ASAS . . . ) have been activated. Then, the system will be provided with the ADS-B position messages received by their own aircraft. The system will only process those ADS-B messages received during determined Time Windows, i.e., the system is only "listening" for short periods of time. These periods of time are shown in FIG. 5 as "time window open?" in decision step 27. Thus, these Time Windows may be called "Time Window Listener" (TWL).

Time Window Listeners (TWLs) are periodic and are synchronized regardless of the system. TWLs may be triggered at the first second of every minute, and are repeated with a period of ten seconds. TWLs allow the system to receive and process at least one ADS-B message of each of the surrounding aircraft. Then, every TWL is identified by the system which comprises a 6-bit counter. If the time window is open, a 6-bit counter is incremented in step 28 with every new TWL and reset after reaching the value 59. This counter is used to identify the TWL during a period of 10 minutes (60 possible values, 0-59). The first TWL ("start timestamp counter") of each hour is assigned the value of zero in step 29. The same value is assigned to the TWL that starts 10 minutes later, twenty minutes later and so on. This way of carrying out the synchronization ensures that each system in a group has the same TWL reference.

The system also comprises an internal counter for every TWL which is used to determine the exact moment of the TWL when an ADS-B message is received. When an ADS-B message is received, as determined in decision step 30, the system determines its timestamp in step M. The timestamp consists of the TWL number ($TW_1, \ldots, TW_n$) and the value of the TWL internal counter. The message is then used by the system to extract both the 24-bit aircraft address in step 32, and the ADS-B position claimed in step 33. These data are recorded into the table in step 34. Then, if the TAT is still open, as determined in decision step 35, the system continues listening and processing the received ADS-B messages by returning to decision step 30. On the other hand, if the TWL is over, the system stops processing ADS-B messages until the next TWL.

Figure 6:
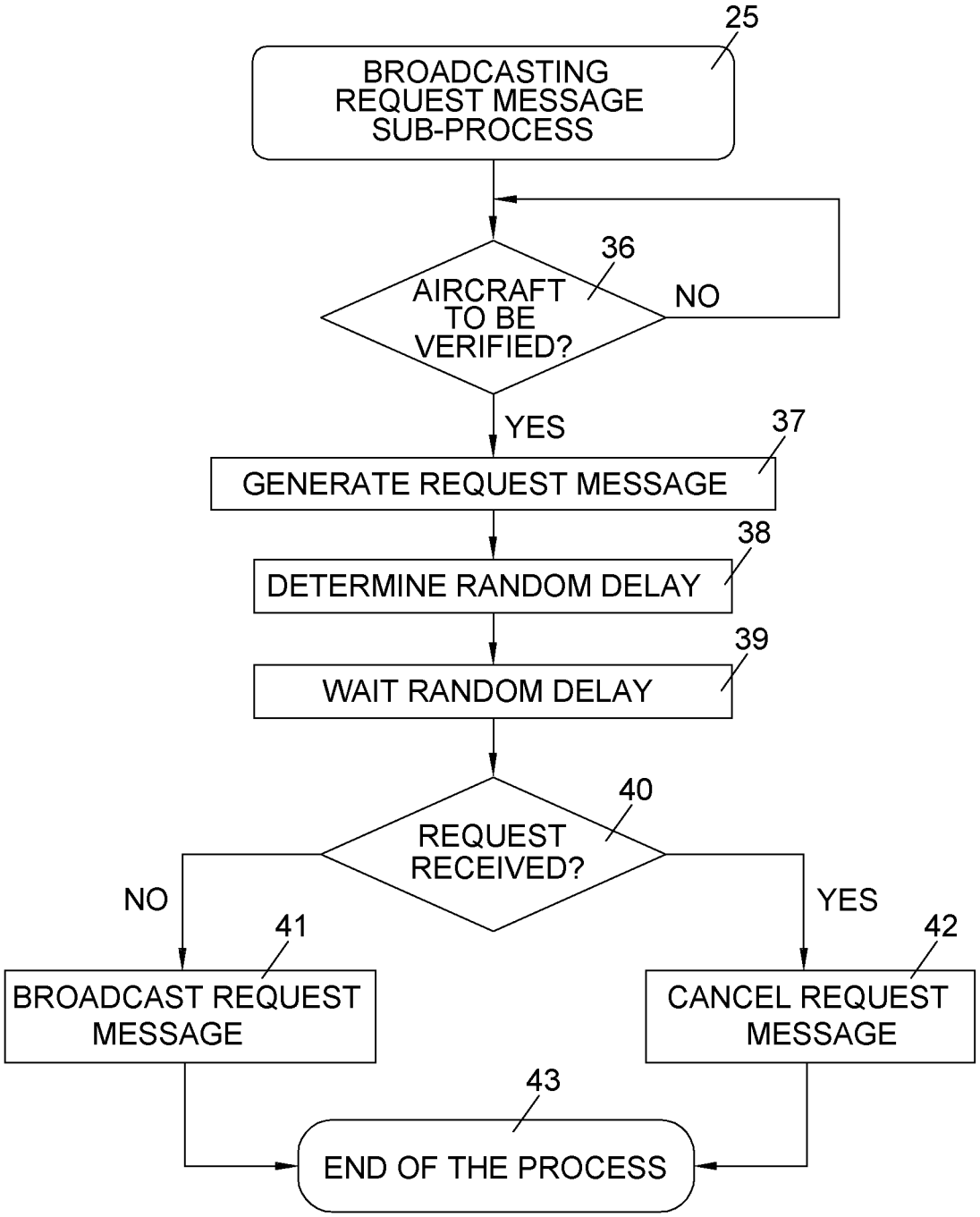
FIG. 6 illustrates a flow chart description of an example of a sub-process for broadcasting request messages in accordance with the present disclosure.

The above mentioned step of broadcasting the request message (step 25 of FIG. 4) is carried out by a sub-process shown in more detail in FIG. 6, i.e., FIG. 6 shows the flow chart that represents the steps performed by the system functionalities in order to broadcast a request to the rest of the nodes of the group. First, the system continuously checks the table in order to determine if there are any nodes to be verified in decision step 36. A node is considered verified when the position claimed by ADS-B matches the position calculated by the MLAT calculation. If a node needs to be verified, the system may need data from the surrounding aircraft (nodes) in order to perform the MLAT calculations. In order to request the data needed, the system broadcasts an interrogation or request message in step 37. With an interrogation, the system is requesting information of the surrounding systems of the surrounding aircraft related to a concrete TWL.

For this purpose, the request message may include a TWL identifier. Before sending the generated request message, the system establishes a random delay in step 38. This delay is meant to establish a stand-by period wherein the system is not required to transmit any request (in step 39), but rather listens to the 1030 MHz channel in order to detect any requests sent by other nodes of the group. If a request is received during the Random Time Delay of step 39, as determined in decision step 40, the system discards the own request message in step 42 and the process ends in step 43. If no request is received during the Random Time Delay, the system broadcasts the own request message in step 41. This message will be received by the rest of the nodes of the group (i.e., aircraft within the ADS-B range) and the response transmission sub-process shall be triggered. Once the request message has been broadcasted the broadcasting of request message sub-process ends in step 23.

Figure 7:
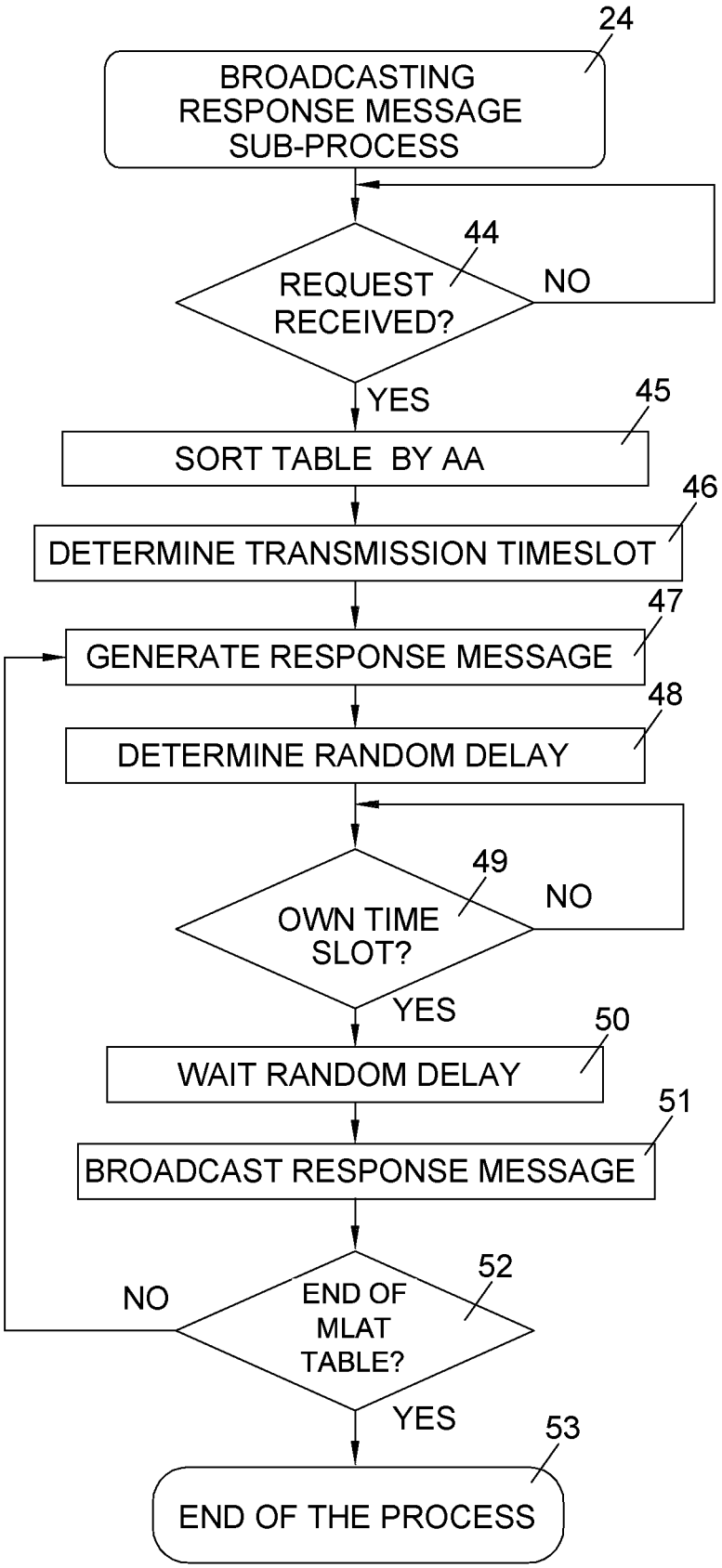
FIG. 7 illustrates a flow chart description of an example of a sub-process for broadcasting response messages in accordance with the present disclosure.

The broadcasting message sub-process 24 of FIG. 4 includes the following steps as shown in the flow chart of FIG. 7. First, the system s continuously listening to the 1030 MHz channel in order to detect any interrogations sent by other nodes. Whey an interrogation is detected in decision step 44, the system broadcasts the information of its own table that may be useful for other nodes to perform calculations. In order to make efficient use of the transmission channel to a greater extent, the method of the present disclosure defines a transmission procedure based on the assignment of transmission time slots. Each of the nodes determines its own transmission time slot. The system first sorts its table by the Aircraft Address (AA) in step 45. The node with the lowest AA may be considered the first in the of nodes of the group. The time slot self-assigned by the system onboard corresponds to its own position in the list in step 46.

Once the system knows its transmission time slot, it generates a response message in step 47. Each of the messages includes information regarding the timestamp of a single ADS-B received message. The message is transmitted during the transmission time slot previously determined. The exact instant to transmit the message is determined by a random time delay in step 48. The function of this random time delay is to reduce the probability of transmission collisions in case two or more nodes have chosen the same transmission time slot. The response message only transmitted during the assigned transmission time slot, as determined in decision step 49. It is transmitted when the random time delay has expired in step 50.

Each system transmits a single response message per time slot. Responses may be broadcast using the 1090 MHz channel at maximum transmission power in step 51. A response message may include data of a single row of the table; thus, steps 47 through 51 are repeated as many times as necessary until the information about each node in the table has been transmitted. Finally, the sub-process ends in step the table is completely transmitted, as determined in decision step 52.

Figure 8:
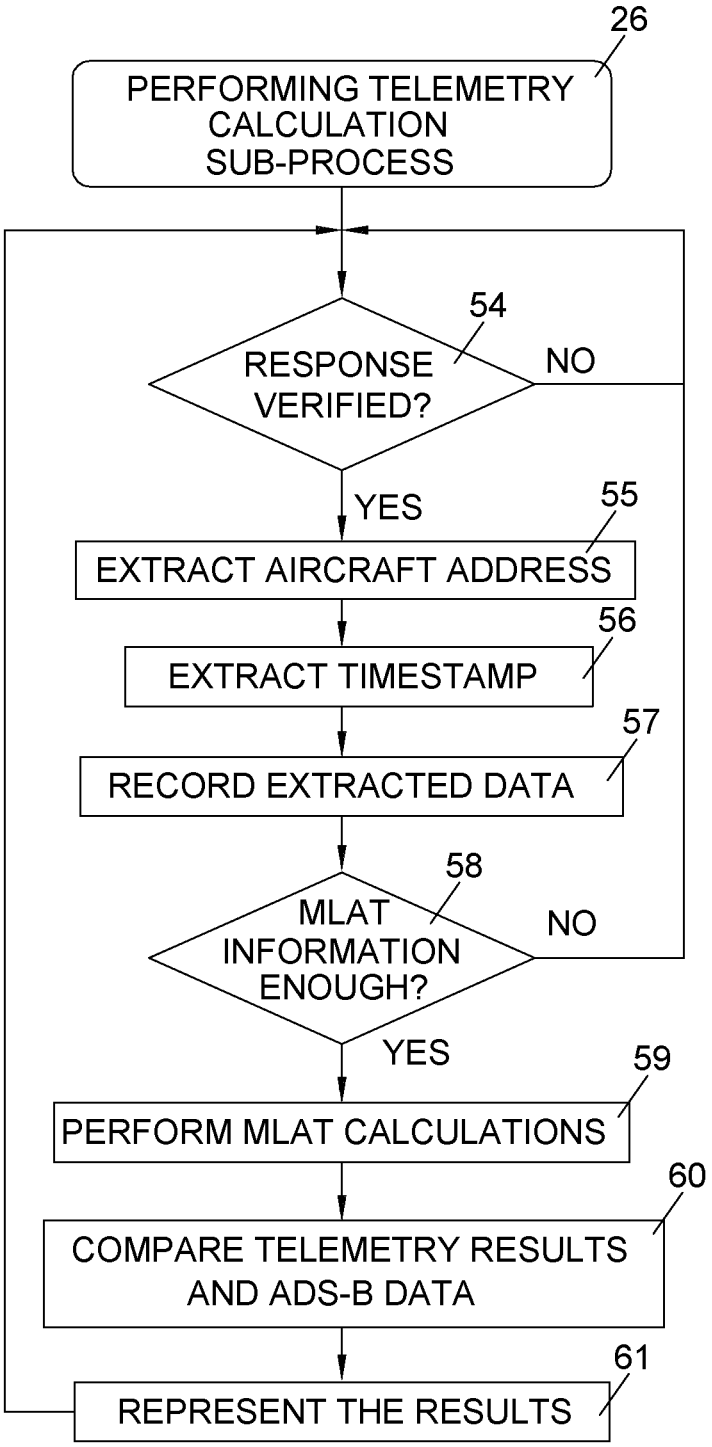
FIG. 8 illustrates a flow chart description of an example of a sub-process for performing telemetry calculations in accordance with the present disclosure.

The above mentioned sub-process of performing telemetry calculations 26 of FIG. 4 is described in more detail as follows. FIG. 8 shows a flow chart which represents the steps performed by the disclosed system in order to perform the calculations and determine the reliability of the ADS-B data received from the nodes of the group. This MLAT calculation is a continuous sub-process that begins in step 26, and may be described as follows: the system is continuously listening for possible responses received from other nodes of the group. When a response message is received, as determined in decision step 54, the system extracts the information including, e.g., the Aircraft Address in step 55 and a timestamp in step 56. Then, the extracted data is recorded in the table in step 57. The system then checks if there is enough information in decision step 58 to perform MLAT calculations to verify the position of the node. If the information available is not enough to verify a node, the system continues to wait for new response messages and steps 54 through 58 are then repeated. If there is enough information, the system performs MLAT calculations in step 59. The system then compares the telemetry results with the position claimed by ADS-B messages 60 and determines if a concrete node is reliable or not. Finally, the system represents the results in step 61 so that the flight crew is aware of the situation in real time.

The circuits, components, modules, and/or devices of, or associated with, the system 1 for verifying ADS-B messages are shown as being connected to or in signal communication with each other, where this connection or signal communication may be any type of connection and/or signal communication between the circuits, components, modules, and/or devices that allows circuit, component, module, and/or device to pass and/or receive signals and/or information from another circuit, component, module, and/or device. The communication and/or connection may be along any signal path between the circuits, components, modules, and/or devices that allows signals and/or information to pass from one circuit, component, module, and/or device to another and includes wireless or wired signal paths. The signal paths may be physical, such as, for example, conductive wires, electromagnetic wave guides, cables, attached and/or electromagnetic or mechanically coupled terminals, semi-conductive or dielectric materials or devices, or other similar physical connections or couplings. Additionally, signal paths may be non-physical such as free-space (in the case of electromagnetic propagation) or information paths through digital components where communication information is passed from one circuit, component, module, and/or device to another in varying digital formats without passing through a direct electromagnetic connection.

It will be understood that various aspects or details of the invention may be changed without departing from the scope of the invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention.

What is claimed is:

1. A system for verifying Automatic Dependent Surveillance-Broadcast (ADS-B) messages received by an aircraft having an ADS-B system, the ADS-B messages received from at least one other aircraft that is airborne and within range of the ADS-B system, the system comprising:

a receiving unit configured to:

demodulate and decode at least one signal received at a Mode S transponder of the ADS-B system of the aircraft, the at least one signal received from a second aircraft;

determine that the at least one signal corresponds to an ADS-B message from the second aircraft in response to demodulation and decoding of the at least one signal; and extract information from the ADS-B message; and a processing unit in signal communication with the receiving unit and configured to:

in response to a determination that the information is not sufficient to enable performance of telemetry calculations, broadcast a request message for additional information to additional airborne aircraft in range of the ADS-B system;

receive, from the receiving unit, additional information responsive to the request message, wherein the information and the additional information are sufficient to enable performance of the telemetry calculations;

determine a position of the second aircraft based on the information and the additional information;

compare the position of the second aircraft with a claimed position of the second aircraft in the ADS-B message to determine whether the ADS-B message is TRUTHFUL or UNTRUTHFUL; and generate a visual representation indicating whether the ADS-B message is TRUTHFUL or UNTRUTHFUL, the visual representation displayed at a screen that is accessible to a flight crew of the aircraft.

2. The system of claim 1, wherein the receiving unit comprises an ADS-B detector configured to identify ADS-B messages from demodulated and decoded signals.

3. The system of claim 1, wherein the processing unit comprises:

a memory configured to store the information, the information comprising an aircraft identification (ID) of the second aircraft, an aircraft position of the second aircraft, and a time-of-arrival for the ADS-B message; and a clock configured to provide a time reference for the system according to a Global Navigation Satellite System (GNSS).

4. The system of claim 1, further comprising a transmitting unit in signal communication with the processing unit, the transmitting unit comprising:

a request transmitter configured to format request messages; and a response transmitter configured to format response messages.

5. The system of claim 1, further comprising a database coupled to the processing unit.

6. The system of claim 1, wherein the position is determined based on multilateration (MLAT) calculations based on a Time-Difference of Arrival (TDOA) of ADS-B messages between the aircraft and the at least one other aircraft.

7. The system of claim 6, wherein the processing unit determines whether to perform the MLAT calculations based on whether there are TDOAs between the aircraft and a predetermined number of other aircrafts.

8. The system of claim 7, wherein the predetermined number of other aircrafts is four or more.

9. The system of claim 1, wherein, in response to the determination that the ADS-B message is not sufficient to enable performance of the telemetry calculations, the processing unit is configured to check whether a request message from another aircraft is received within a time delay.

10. The system of claim 9, wherein the processing unit is configured to initiate a broadcast of a response message in response to a determination that the request message was received within the time delay, the response message including the information extracted from the ADS-B message.

11. The system of claim 9, wherein, after the time delay, the processing unit initiates the broadcast of the request message.

12. A first aircraft comprising a system for verifying Automatic Dependent Surveillance-Broadcast (ADS-B) messages received from other aircraft, the first aircraft comprising;

an ADS-B system, the ADS-B system including a display screen;

a Mode S transponder;

a receiver unit to demodulate and decode signals received from the Mode S transponder, wherein the receiver unit determines a type of message received and then extracts information from each type of message, the types of message being an ADS-B message, a request message, and a response message; and a processor unit in signal communication with the receiver unit, wherein the processor unit is configured to perform operations, the operations including:

in response to a determination that first information extracted from a first ADS-B message is not sufficient to enable performance of telemetry calculations associated with a second aircraft in an ADS-B range of the ADS-B system, broadcasting a first request message for additional information to additional aircraft in the ADS-B range;

receiving additional information responsive to the first request message, wherein the first information and the additional information are sufficient to enable performance of the telemetry calculations;

determining a position of the second aircraft based on the first information and the additional information, wherein the first information and the additional information are sufficient to enable performance of the telemetry calculations;

comparing the position of the second aircraft with a claimed position of the second aircraft in the first ADS-B message to determine whether the ADS-B message is TRUTHFUL or UNTRUTHFUL; and generating a visual representation indicating whether the ADS-B message is TRUTHFUL or UNTRUTHFUL, the visual representation displayed to the display screen.

13. The first aircraft of claim 12, wherein the receiver unit comprises: an ADS-B detector, a request detector, and a response detector; wherein the ADS-B detector identifies ADS-B messages; wherein the request detector identifies request messages; and wherein the response detector identifies response messages.

14. The first aircraft of claim 13, wherein the processor unit comprises: a table, a brain, and a clock; the table including a memory for storing particular information to be provided to the brain; the clock providing a time reference for the system according to a Global Navigation Satellite System; the brain including a processor configured to:

store the first information contained in the table, the first information comprising an aircraft ID of the second aircraft, a claimed aircraft position for the second aircraft, and a time of arrival for the first ADS-B message;

perform telemetry calculations for the second aircraft; and compare results of the telemetry calculations with the claimed aircraft position;

determine when to send the first request message; and determine whether to send a response message responsive to a received request message and any received response messages associated with the received request message.

15. The first aircraft of claim 14, wherein the telemetry calculations performed by the brain are multilateration (MLAT) calculations based on a Time-Difference of Arrival (TDOA) of ADS-B messages between the second aircraft and a plurality of receiving aircraft.

16. A method of verifying Automatic Dependent Surveillance-Broadcast (ADS-B) messages received by an aircraft having an ADS-B system, the method comprising:

demodulating and decoding at least one signal received at a Mode S transponder of the ADS-B system of the aircraft, the at least one signal received from a second aircraft;

determining that the at least one signal corresponds to an ADS-B message from the second aircraft in response to demodulation and decoding of the at least one signal;

extracting information from the ADS-B message;

in response to a determination that the information is not sufficient to enable performance of telemetry calculations, broadcasting a request message for additional information to additional airborne aircraft in range of the ADS-B system;

receiving additional information responsive to the request message, wherein the information and the additional information are sufficient to enable performance of the telemetry calculations;

determining a position of the second aircraft based on the information and the additional information;

comparing the position of the second aircraft with a claimed position of the second aircraft in the ADS-B message to determine whether the ADS-B message is TRUTHFUL or UNTRUTHFUL; and generating a visual representation indicating whether the ADS-B message is TRUTHFUL or UNTRUTHFUL, the visual representation displayed at a screen that is accessible to a flight crew of the aircraft.

17. The method of claim 16, further comprising identifying ADS-B messages from demodulated and decoded signals.

18. The method of claim 16, wherein the position is determined based on multilateration (MLAT) calculations based on a Time-Difference of Arrival (TDOA) of ADS-B messages between the aircraft and at least one other aircraft.

19. The method of claim 18, further comprising determining whether to perform the MLAT calculations based on whether there are TDOAs between the aircraft and a predetermined number of other aircrafts.

20. The method of claim 16, further comprising broadcasting the request message after a second determination that a second request message for information corresponding to the second aircraft has not been received.

* * * * *